US005619243A

United States Patent [19]

Hotta et al.

[11] Patent Number: 5,619,243

[45] Date of Patent: Apr. 8, 1997

[54] IMAGE RECORDING AND ERASING METHOD

[75] Inventors: Yoshihiko Hotta; Akira Suzuki, both of Mishima; Makoto Obu, Yokohama; Takashi Kitamura, Ichikawa, all of Japan

[73] Assignee: Ricoh Company, Ltd., Tokyo, Japan

[21] Appl. No.: 344,574

[22] Filed: Nov. 18, 1994

[30] Foreign Application Priority Data

Nov. 18, 1993 [JP] Japan ..... 5-312557

[51] Int. Cl.[6] ..... B41J 2/385

[52] U.S. Cl. ..... 347/139; 347/262; 346/135.1

[58] Field of Search ..... 347/262, 264, 347/221, 164, 139; 106/21 R, 21 A, 21 C; 503/200, 201, 208, 217; 346/135.1

[56] References Cited

U.S. PATENT DOCUMENTS

| | | | |
|---|---|---|---|
| 5,087,601 | 2/1992 | Hotta et al. | 503/200 |
| 5,158,924 | 10/1992 | Konagaya et al. | 503/201 |
| 5,278,128 | 1/1994 | Hotta et al. . | |
| 5,298,476 | 3/1994 | Hotta et al. . | |
| 5,371,522 | 12/1994 | Miyawaki et al. . | |
| 5,379,058 | 1/1995 | Obu et al. . | |
| 5,426,086 | 6/1995 | Hotta et al. . | |
| 5,448,065 | 9/1995 | Masubuchi et al. . | |

*Primary Examiner*—Mark J. Reinhart
*Attorney, Agent, or Firm*—Oblon, Spivak, McClelland, Maier & Neustadt, P.C.

[57] ABSTRACT

An image recording and erasing method for recording images and erasing the same repeatedly by use of a reversible thermosensitive recording medium which is capable of reversibly changing the transparency and color tone thereof depending upon the temperature thereof, includes the steps (a) disposing a light-to-heat conversion sheet above the reversible thermosensitive recording medium; (b) applying a laser beam to the light-to-heat conversion sheet to heat the reversible thermosensitive recording medium by the heat generated by the light-to-heat conversion sheet upon the application of the laser beam thereto, thereby forming images on the reversible thermosensitive recording medium and/or erasing images therefrom; and (c) removing the light-to-heat conversion sheet away from the reversible thermosensitive recording medium.

22 Claims, 3 Drawing Sheets

IMAGE RECORDING AND ERASING METHOD

BACKGROUND OF THE INVENTION

1. Field of the Invention

The present invention relates to an image recording and erasing method for clearly recording images and erasing the same repeatedly for an extended period of time by use of a reversible thermosensitive recording medium which is capable of reversibly changing the transparency and/or color thereof depending upon the temperature thereof.

2. Discussion of Background

Recently attention has been paid to a reversible thermosensitive recording medium which is capable of recording images temporarily therein and erasing recorded images therefrom when such images become unnecessary, and which is also capable of performing such image recording and erasing operations repeatedly.

Representative examples of such a reversible thermosensitive recording medium are disclosed, for instance, in Japanese Laid-Open Patent Applications 54-119377 and 55-154198, in which an organic low-molecular-weight material such as a higher fatty acid is dispersed in a matrix resin such as a vinyl chloride-vinyl acetate copolymer.

However, when images are formed in such a conventional reversible thermosensitive recording medium and erased therefrom repeatedly many times by the application of heat thereto, in particular, by using a thermal head, the surface of the reversible thermo-sensitive recording medium is scratched because the surface is fractioned while heat is applied thereto, and eventually it becomes impossible to form images uniformly on the recording medium.

Furthermore, for instance, when a heat application system, by use of a thermal head, which applies both head and pressure to the recording medium, is employed, particles of the organic low-molecular-weight material aggregate as the repeated number of recording operations is increased. As a result, the contrast of images, that is, the degree of white opaqueness thereof, is lowered.

For reducing such deterioration of the reversible thermosensitive recording medium, a method of heating a reversible thermosensitive recording layer by use of a non-contact heat application means has been proposed and known. According to this method, even if the reversible thermosensitive recording layer is softened by the application of heat thereto, no pressure is applied thereto, so that the deterioration of the recording medium can be reduced. For example, Japanese Laid-Open Patent Application 57-82088 proposes a method recording images by the application of a laser beam to reversible thermosensitive recording medium which comprises (a) a reversible thermosensitive recording layer which contains carbon black or (b) a carbon-black containing layer which is provided in close vicinity to a reversible thermosensitive recording layer. According to this proposed method, non-contact recording can be performed, but obtained images are grayish in entirety thereof and the image contrast thereof is considerably low either when carbon black is contained in the reversible thermosensitive recording layer or when the carbon-back containing layer is provided in close vicinity to the reversible thermosensitive recording layer as mentioned above.

Furthermore, Japanese Laid-Open Patent Application 64-14077 proposes the same method as mentioned above except that the carbon black is replaced by an infrared absorbing dye. According to this proposed method, the image contrast is slightly improved in comparison with the case where carbon black is employed, but the infrared absorbing dye absorbs visible light, so that the obtained image contrast is still low and insufficient for use practice.

SUMMARY OF THE INVENTION

It is therefore an object of the present invention to provide an image recording and erasing method for recording images with high contrast, accuracy and clearness, and erasing the same repeatedly with high erasing durability for an extended period of time by use of a reversible thermosensitive recording medium which is capable of reversibly changing the transparency and color tone thereof depending upon the temperature thereof.

This object of the present invention can be achieved by an image recording and erasing method for recording images and erasing the same repeatedly by use of a reversible thermosensitive recording medium which is capable of reversibly changing the transparency and color tone thereof depending upon the temperature thereof, comprising the steps (a) disposing a light-to-heat conversion sheet over the reversible thermosensitive recording medium; (b) applying a laser beam to the light-to-heat conversion sheet to heat the reversible thermo-sensitive recording medium by the heat generated by the light-to-heat conversion sheet upon the application of the laser beam thereto, thereby forming images on the reversible thermosensitive recording medium and/or erasing images therefrom; and (c) removing the light-to-heat conversion sheet away from the reversible thermo-sensitive recording medium.

In the above image recording and erasing method, at least part of the light-to-heat conversion sheet may be in contact with at least part of the reversible thermosensitive recording medium, and it is preferable that the adhesion initiation temperature at which the adhesion between the light-to-heat conversion sheet and the reversible thermosensitive recording medium is initiated be above 90° C., more preferably above 150° C.

Furthermore, a heat resistant layer may be provided on a top surface portion of the light-to-heat conversion sheet which is directed to the reversible thermosensitive recording medium.

The light-to-heat conversion sheet may comprise a support and a light-to-heat conversion layer formed thereon, which comprises a cross-linked resin.

The light-to-heat conversion sheet and the thermosensitive recording medium may be overlaid with a non-contact space therebetween, preferably with a non-contact space of 0.1 μm to 20 μm. The non-contact space may contain spacer particles or a liquid.

The image recording and erasing method of the present invention may further comprise the step of heating the reversible thermosensitive recording medium by heat application means after or before disposing the light-to-heat conversion sheet over the reversible thermosensitive recording medium.

Further, a specific example of the reversible thermosensitive recording medium for use in the image recording and erasing method of the present invention comprises a matrix resin and an organic low-molecular-weight material having a minimum crystallization temperature, which is dispersed in the form of particles in the matrix resin, and is capable of reversibly changing the transparency thereof from a transparent state to a milky white opaque state and vice versa by the application of heat thereto, and when applying a laser beam to the light-to-heat conversion sheet to heat the reversible thermosensitive recording medium for forming images on the reversible thermosensitive recording medium and/or erasing images therefrom, the reversible thermosensitive recording medium is heated to a temperature higher than the minimum crystallization temperature of the organic low-molecular-weight material. In the image recording and erasing method of the present invention, images may be formed by heating the reversible thermosensitive recording medium by applying the laser beam to the light-to-heat conversion sheet, and images may be erased by heating the reversible thermosensitive recording medium by heat application means.

Specific examples of the above heater application means are a hot stamp, a heat roller, an oven and a thermal head.

Furthermore, in the image recording and erasing method of the present invention, both the formation of the images on the reversible thermosensitive recording medium and the erasure of images therefrom may be carried out by the application of laser beams to the light-to-heat conversion sheet, with at least one factor selected from the group consisting of the irradiation time, light quantity, focusing and intensity distribution of the laser beams being controlled.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

With reference to the accompanying drawings, the present invention will now be explained in detail.

Figure 1:
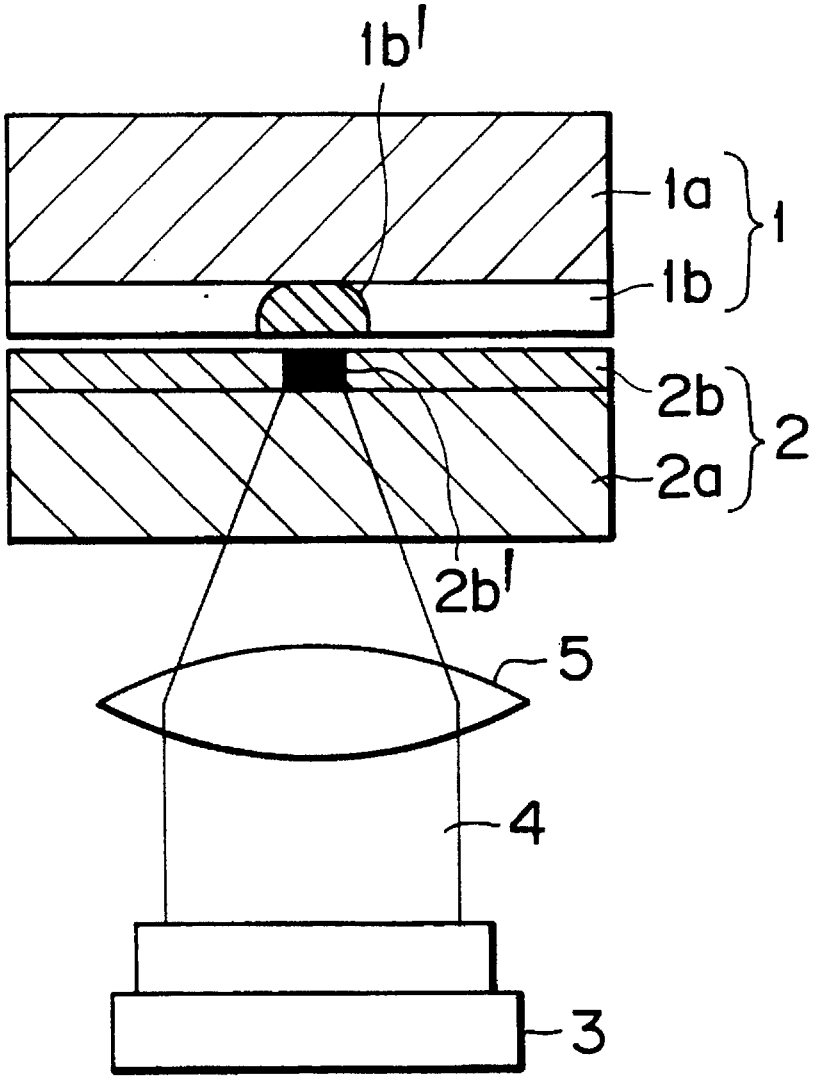
FIG. 1 is a schematic diagram in explanation of the principle of the image recording and erasing method according to the present invention.

FIG. 1 is a schematic diagram in explanation of the principle of the image recording and erasing method of the present invention.

As shown in FIG. 1, a reversible thermosensitive recording medium 1 comprising a support 1*a* and a thermosensitive recording layer 1*b* is overlaid on or above a light-to-heat conversion sheet 2 comprising a support 2*a* and a light-to-heat conversion layer 2*b* in such a manner that the light-to-heat conversion layer 2*b* comes into contact with the thermosensitive recording layer 1*b*, and a laser beam 4 is applied by a laser beam source 3 to the light-to-heat conversion sheet 2 so as to condense on the light-to-heat conversion layer 2*b* through a lens 5, whereby heat is generated at a laser-beam-condensed portion 2*b*′ by which recording is performed at a recording portion 1*b*′ of the thermosensitive recording layer 1*b*.

The light-to-heat conversion layer 2*b* may made of any material as long as it is capable of absorbing the laser beam 4. However, it is preferable that the light-to-heat conversion layer 2*b* be made of a material which does not reduce the contrast of images to be made on the reversible thermosensitive recording medium 1, because images formed on the reversible thermosensitive recording medium 1 are observed with the light-to-heat conversion sheet 2 being separated away from the reversible thermo-sensitive recording medium.

With reference to FIG. 1, the laser beam 4 is applied to the light-to-heat conversion sheet 2. However, the laser beam 4 may also be applied to the side of the support 1*a* of the reversible thermosensitive recording medium 1. In this case, it is required that the support 1 be transparent or semi-transparent to the laser beam 4 applied thereto.

Figure 2:
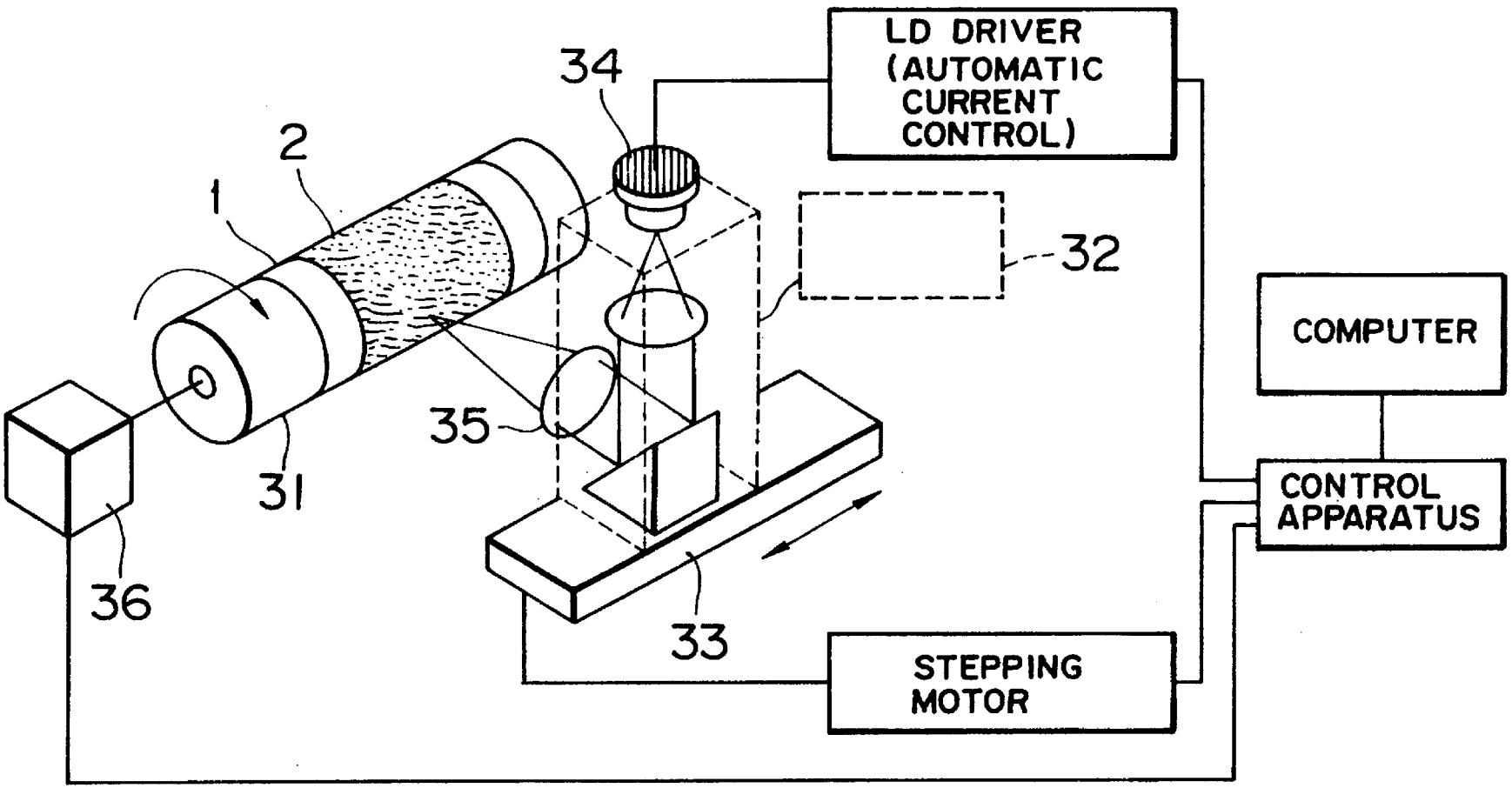
FIG. 2 is a schematic illustration of an example of a laser recording apparatus for use in the image recording and erasing method according to the present invention.

FIG. 2 shows an example of a laser image recording apparatus for the image recording and erasing method of the present invention, in which the reversible thermo-sensitive recording medium 1 and the light-to-heat conversion sheet 2 are wound around a drum 31. In this image recording apparatus, an image recording position is determined by controlling the rotation of the drum 31 and the movement of a microstage 33 of an optical head 32. In FIG. 2, reference numeral 34 indicates a semiconductor laser diode; reference numeral 35, a focus lens; and reference 36, a DC motor.

Instead of using the image recording apparatus as shown in FIG. 2, it is also possible to determine the image recording position by placing the reversible thermosensitive recording medium 1 and the light-to-heat conversion sheet 2 on an X-Y stage (not shown) and controlling the stage position therefor.

Furthermore, such an image recording position can also be determined by use of a Galvanomirror for changing the optical path for the laser beam in an optical system.

According to the image recording and erasing method of the present invention, image recording and erasing can be carried out by use of low energy by disposing the light-to-heat conversion sheet in close vicinity to or in contact with the reversible thermosensitive recording medium.

In this case, it is preferable that the adhesion initiation temperature at which the adhesion between the light-to-heat conversion sheet and the reversible thermosensitive recording medium is initiated be above 90° C.

This adhesion initiation temperature is measured by the steps of (a) disposing the reversible thermosensitive recording medium 1 and the light-to-heat conversion sheet 2 as shown in FIG. 1, namely, by overlaying the reversible thermosensitive recording medium 1 comprising the support 1*a* and the thermosensitive recording layer 1*b* on the light-to-heat conversion sheet 2 comprising the support 2*a* and the light-to-heat conversion layer 2*b* in such a manner that the light-to-heat conversion layer 2*b* comes into contact with the thermosensitive recording layer 1*b*, (b) applying heat thereto with the application of a pressure of 1 g/cm$^2$ for 60 seconds by use of a commercially available heat gradient tester (Trademark "Type HG-100" made by Toyo Seiki Seisakusho, Ltd.), and (c) peeling the light-to-heat conversion sheet 2 away from the reversible thermosensitive recording medium 1.

In the present invention, that the adhesion initiation temperature is above 90° C. means that even when heat is applied to the superimposed light-to-heat conversion sheet 2 and the reversible thermosensitive recording medium 1 to of 90° C. in the above-mentioned step (b), no adhesion is observed between the two and accordingly, no components are transferred between the two when the light-to-heat conversion sheet 2 is peeled away from the reversible thermosensitive recording medium 1 in the above-mentioned step (c). It is more preferable that the above adhesion initiation temperature be above 150° C.

When the above-mentioned adhesion initiation temperature is 90° C. or less, part of the light-to-heat conversion layer 2*b* of the light-to-heat conversion sheet 2 is transferred to the thermosensitive recording layer 1*b* of the reversible thermosensitive recording medium 1, or part of the thermosensitive recording layer 1*b* of the reversible thermosensitive recording medium 1 is transferred to the light-to-heat conversion layer 2*b* of the light-to-heat conversion sheet 2, or at least one of the thermosensitive recording layer 1*b* or the light-to-heat conversion layer 2*b* is partly or in its entirety peeled away from the respective support 1*a* or 2*a*. This will have adverse effects on the image formation and erasure in the present invention.

In order to prevent the above, it is preferable to provide a heat resistant layer on a top surface portion of the reversible thermosensitive recording medium 1 which comes into contact with the light-to-heat conversion sheet 2, or on a top surface portion of the light-to-heat conversion sheet 2 which comes into contact with the reversible thermosensitive recording medium 1, or on both of the respective top surface portions thereof.

Alternatively, it is possible to prevent the above-mentioned problems by increasing the heat resistance of each of the thermosensitive recording layer 1*b* and the light-of-heat conversion layer 2*b* by use of a resin having high glass transition point (Tg) therein or by cross-linking a resin employed in the respective layers.

It is preferable that the above cross-linking be carried out by the application of heat, ultraviolet rays, or electron rays.

More specifically, the adhesion initiation temperature above 90° C. can be attained by providing a heat resistant layer on a top surface portion of the reversible thermosensitive recording medium 1 which comes into contact with the light-to-heat conversion sheet 2, or on a top surface portion of the light-to-heat conversion sheet 2 which comes into contact with the reversible thermosensitive recording medium 1; or by cross-linking the resin employed either in the thermosensitive recording layer 1*b* or in the light-to-heat conversion layer 2*b*.

Furthermore, the adhesion initiation temperature above 150° C. can be attained by providing a heat resistant layer on a top surface portion of the reversible thermosensitive recording medium 1 which comes into contact with the light-to-heat conversion sheet 2, and also on a top surface portion of the light-to-heat conversion sheet 2 which comes into contact with the reversible thermosensitive recording medium 1; or by cross-linking the resins employed both in the thermo-sensitive recording layer l*b* and in the light-to-heat conversion layer 2*b*; or by providing the heat resistant layers and cross-linking the resins in the thermo-sensitive recording layer 1*b* and in the light-to-heat conversion layer 2*b*.

The light-to-heat conversion layer 2*b* is capable of absorbing light and generating heat by converting the absorbed light into heat.

Main materials for the light-to-heat conversion layer 2*b* can be classified into inorganic materials and organic materials.

Specific examples of the inorganic materials include carbon black, metals or semi-metals such as Ge, Bi, In, Te, Se and Cr, and alloys thereof. These materials can be deposited in the form of a layer by vacuum deposition, or formed into a layer by use of a binder resin in which finely-divided particles of any of these materials are dispersed.

As organic materials, varieties of dyes can be employed, depending upon the light beams with various wavelengths to be absorbed. In the case where a semiconductor laser is employed as a light source, near infrared absorbing dyes with absorption wavelength near 700 to 900 nm can be employed. Specific examples of such dyes are cyanine dyes, quinone dyes, quinoline derivatives of indonaphthol, phenylenediamine based nickel complexes, and phthalocyanine based dyes. These dyes are usually employed in combination with a resin.

Any resins can be employed for the light-to-heat conversion layer 2*b* as long as such resins can support the above-mentioned inorganic end organic materials.

Specific resins for use in the light-to-heat conversion layer 2*b* are as follows:

Thermoplastic Resins: ethylene-vinyl chloride copolymer resin, ethylene-vinyl acetate copolymer, ethylene-vinyl acetate-vinyl chloride graft polymerized resin, vinylidene chloride resin, vinyl chloride resin, chlorinated vinyl chloride resin, chlorinated polyethylene, chlorinated polypropylene, vinyl acetate resin, phenoxy resin, butadiene resin, fluoroplastics, polyamide, polyamide imide, polyarylate, thermoplastic polyimide, polyether imide, polyether ether ketone, polyethylene, polyethylene oxide, polycarbonate, polystyrene, polysulfone, poly-p-methyl styrene, polyallylamine, polyvinyl alcohol, polyvinyl ether, polyvinyl butyral, polyvinyl formal, polyphenylene ether, polypropylene, polymethyl pentene, methacryl resin and acrylic resin.

Thermoset Resins: epoxy resin, xylene resin, guanamine resin, diallyl phthalate resin, vinyl ester resin, phenolic resin, unsaturated polyester resin, furan resin, polyimide, polyurethane, maleic acid resin, melamine resin and urea resin.

As the resins for use in the light-to-heat conversion sheet 2, copolymers made from monomers for the above resins can be employed. Furthermore, the above-mentioned resins can be employed in combination.

It is preferable that the ratio by parts by weight of the previously mentioned inorganic materials and/or organic materials for use in the light-to-heat conversion sheet 2 to any of the above-mentioned resins be in a range of 95:5 to 5:95, more preferably in a range of 90:10 to 10:90.

When necessary, the above-resins, with the addition of a functional group such as hydroxyl group or carboxyl group thereto, may be cross-linked in the presence of a cross-linking agent by the application of heat, ultraviolet rays or electron rays thereto. Specific examples of the cross-linking agent are isocyante derivatives and the following acrylate monomers:

hexanediol diacrylate (HDDA), neopentyl glycol diacrylate (NPGDA), diethylene glycol diacrylate (DEGDA), tripropylene glycol diacrylate (TPGDA), polyethylene glycol diacrylate (PEG400DA), neopentyl glycol hydroxypivalate (MANDA)(HPNDA), diacrylate of neopentyl glycol adipate, diacrylate of ε-caprolactone adduct of neopentyl glycol hydroxypivalate, 2-(2-hydroxy-1,1-dimethylethyl)-5-hydroxymethyl-5-ethyl-1,3-dioxanediacrylate, tricyclodecane dimethylol diacrylate, ε-caprolactone adduct of tricyclodecane dimethylol diacrylate, diacrylate of diglycidyl ether of 1,6-hexanediol, trimethylolpropane triacrylate (TMPTA), propionic acid dipentaerythritol triacrylate, hydroxypivalaldehyde-modified dimethylolpropane triacrylate, propionic acid dipentaerythritol tetraacrylate, ditrimethylolpropane tetraacrylate, pentaacrylate of dipentaerythritol propionate, dipentaerythritol hexaacrylate (DPHA), ε-caprolactone adduct of dipentaerythritol hexaacrylate (DPCA-20), ε-caprolactone adduct of dipentaerythritol hexaacrylate (DPCA-30), ε-caprolactone adduct of dipentaerythritol hexaacrylate (DPCA-60), diacrylate of propylene oxide adduct of neopentyl glycol, diacrylate of ethylene oxide adduct of neopentyl glycol hydroxypivalate, triacrylate of propylene oxide adduct of trimethylolpropane, triacrylate of higher fatty acid ester of pentaerythritol, pentaacrylate of 1,3-dioxanepentanol, hexaacrylate of ε-caprolactone adduct of dipentaerythritol, diacrylate of ε-caprolactone adduct of neopentyl glycol of hydroxypivalate, and diacrylate of ε-caprolactone adduct of tricyclodecane dimethylol.

When the above-mentioned cross-linking is performed by use of ultraviolet rays, a photopolymerization initiator such as benzophenone is employed.

As mentioned previously, a heat resistant layer may be provided on the top surface portion of the light-to-heat conversion layer **2*b* of the light-to-heat conversion sheet 2**.

The heat resistant layer usually comprises a resin as a main component, to which an organic or inorganic filler may be added, when necessary.

As the resin for the heat resistant layer, it is preferable to use resins with a glass transition point (Tg) of 90° C. or more, more preferably resins with a glass transition point (Tg) of 150° C. or more, selected from the previously mentioned resins for use in the light-to-heat conversion layer **2*b***.

The above resins to be used for the heat resistant layer may be cross-linked in the same manner as in the case of the previously mentioned resins for the light-to-heat conversion layer **2*b*** by use of the previously mentioned cross-linking agents and the photopolymerization initiator under the application of heat, ultraviolet ray, or electron rays thereto.

As another method for forming the heat resistant layer, a method of forming a heat resistant layer by cross-linking a prepolymer by use of a cross-linking agent can be employed.

Specific examples of such a prepolymer include polyurethane acrylate, polyepoxy acrylate, and polyol.

As the above-mentioned cross-linking agent, the previously mentioned acrylate monomers can be employed.

The above prepolymers can be cross-linked under the application of electron rays or ultraviolet rays. For this cross-linking, the previously mentioned photopolymerization initiator may be employed.

Furthermore, conventional sensitizers may also be employed.

When a coating liquid is employed for the formation of the heat resistant layer, a monofunctional acrylate monomer may be added as a reactive diluent to the coating liquid in order to adjust the viscosity of the coating liquid.

It is preferable that the heat resistant layer have a thickness in a range of 0.01 μm to 5 μm, more preferably in a range of 0.01 μm to 2 μm.

It is preferable that the light-to-heat conversion layer **2*b*** have a thickness of about 100 Å to 3 μm, more preferably a thickness of 500 Å to 2 μm.

As the material for the support **2*a* for the light-to-heat conversion sheet 2, glass and a plastic sheet can be employed. As the material for the plastics sheet, for example, PET, polysulfone, polyimide and polycarbonate can be employed. It is preferable that the support 2*a* for the light-to-heat conversion sheet 2** have a thickness in a range of about 2 μm to 1 mm, more preferably in a range of 4 μm to 500 μm.

When necessary, an adhesive layer comprising a resin as a main component may be interposed between the support **2*a* and the light-to-heat conversion layer 2*b*** in order to improve the adhesion therebetween.

The light-to-heat conversion sheet 2 may also be disposed out of contact with the reversible thermo-sensitive recording medium 1 with a non-contact space therebetween. In this case, it is preferable that the non-contact space be in a range of 0.1 μm to 20 μm, more preferably in a range of 0.1 μm to 10 μm, most preferably in a range of 0.2 μm to 7 μm.

In order to maintain the light-to-heat conversion sheet 2 out of contact with the reversible thermo-sensitive recording medium 1 with such a non-contact space therebetween, spacer particles or a liquid may be placed in the non-contact space.

The size of such spacer particles may be selected in accordance with the size of the non-contact space. The form of such spacer particles may be spherical, plate-shaped, needle-shaped or indeterminate. However, it is preferable that the size of the spacer particles be uniform.

The materials for the spacer particles may be either inorganic materials or organic materials. Examples of inorganic materials for the spacer particles include, varieties of metals, metallic compounds such as aluminum oxide, and magnesium oxide, and also silica. Examples of organic materials for the spacer particles include polystyrene, fluorine plastics, silicone resin and silicone rubber.

Specific examples of the liquid to be placed in the non-contact space include silicone oil, fluorocarbon oil, fatty acids, phenolic compounds, alcohols, ketones and esters.

It is preferable that recording portions of the reversible thermosensitive recording medium 1 be heated when recording is performed. This is because when the recording portions are heated to a predetermined temperature above room temperature, the thermosensitivity of the recording portions is not varied by changes in the ambient temperature, so that clear images can be constantly obtained, and recorded images can be erased uniformly. Further, the thermosensitivity of the recording portions can be increased.

Such recording portions of the reversible thermo-sensitive recording medium 1 can be heated by heat application means such as a heater which heats a portion with which such recording portions are in contact. The reversible thermosensitive recording medium 1 can be heated, for instance, by a heater built in the drum 31 around which the reversible thermosensitive recording medium 1 is wound.

It is not always necessary that the recording portions of the reversible thermosensitive recording medium 1 be heated when a laser beam is being applied to the light-to-heat conversion sheet 2. The recording portions may be heated prior to the application of the laser beam thereto, to the light-to-heat conversion sheet 2, so that the temperature of the recording portions is raised above a predetermined temperature when recording is carried out.

It is also preferable that the light-to-heat conversion sheet 2 be also heated when recording is performed in order to improve the overall thermo-sensitivity for the recording.

In the case where a reversible thermosensitive recording medium which is capable of erasing images at a first temperature and forming images at a second temperature is employed, if the temperature for the above-mentioned heating is set at the first temperature, images can be erased when heated to the first temperature, and at the same time, the thermosensitivity of the reversible thermosensitive recording medium can also increased when forming images with the application of a laser beam by heating the recording medium imagewise to the second temperature.

In the case where there is employed a reversible thermosensitive recording medium comprising a matrix resin and an organic low-molecular-weight material having a minimum crystallization temperature, which is dispersed in the form of particles in the matrix resin, and is capable of reversibly changing the transparency thereof from a transparent state to a milky white opaque state and vice versa by the application of heat thereto, and when a laser beam is applied to the light-to-heat conversion sheet to heat the reversible thermosensitive recording medium for forming images on the reversible thermosensitive recording medium and/or erasing images therefrom, it is preferable that the reversible thermosensitive recording medium be heated to a temperature higher than the minimum crystallization temperature of the organic low-molecular-weight material.

When the reversible thermosensitive recording medium is not heated to a temperature higher than the minimum crystallization temperature of the organic low-molecular-weight material, it is difficult to obtain a sufficient milky white opaque state for use in practice. It is considered that this is because when the reversible thermosensitive recording medium is heated only through the application of the laser beam thereto, the laser-beam-applied portions are rapidly cooled upon the termination of the application of the laser beam, so that the glass transition of the matrix resin is caused to slow down by the crystallization of the organic low-molecular-weight material, end therefore it is difficult to obtain a sufficient milky white opaque state as mentioned above.

The above-mentioned minimum crystallization temperature can be measured by peeling or cutting the reversible thermosensitive recording layer 1*b* away from the support 1*a*, heating the recording layer 1*b* by a differential scanning calorimeter (DSC) to a temperature at which the organic low-molecular-weight material contained in the recording layer 1*b* is completely fused, and then cooling the recording layer 1*b*. The minimum crystallization temperature is the temperature at which the exothermic phenomenon is completed in the DeC curve, namely, the temperature at which the crystallization of the organic low-molecular-weight material is finished. It is required that the cooling rate in the above measurement by use of the DSC be 2° C./min or less.

It is also possible to erase images formed on the reversible thermosensitive recording medium 1 or heat the reversible thermosensitive recording medium 1 by heating means other than the drum 31 shown in FIG. 2. Examples of such heating means include a hot stamp, a heat roller and a thermal head.

It is also possible to form images and erase images by controlling the laser beam application or irradiation conditions by use of the apparatus as illustrated in FIG. 2. To be more specific, by controlling at least one factor selected from the group consisting of the irradiation time, light quantity, focusing and intensity distribution of the laser beams, the heating temperature for the first temperature or second temperature for the previously mentioned reversible thermosensitive recording medium can be controlled, and the cooling rate thereof after the heating can also be controlled, whereby image formation and overall or partial erasure of images can be carried out.

As the light source for light irradiation apparatus, any light source can be employed as long as it is capable of emitting light which can be absorbed by the light-to-heat conversion layer 2*b* and by which heat is generated in the light-to-heat conversion layer 2*b*. However, a laser beam is most preferably employed because it is easy to concentrate the light beam. A semi-conductor laser is preferable for producing the above-mentioned laser beams because of its compact size.

A reversible thermosensitive recording material, which is capable of reversibly changing the transparency or color tone thereof depending upon the temperature thereof, for the reversible thermosensitive recording layer of the reversible thermosensitive recording medium for use in the present invention is such a material that the above-mentioned reversible changes are visible. Such visible changes can be classified into changes in the color and changes in the shape thereof. However, in the present invention, a reversible thermosensitive recording material which is capable of changing the color thereof is mainly employed. The changes in the color include changes in the transparency, reflectivity, absorption wavelength and scattering degree. In the reversible thermosensitive recording medium for use in the present invention, image display is performed by use of the above changes in combination.

To be more specific, any recording materials capable of reversibly changing the transparency or color tone thereof depending upon the temperature thereof can be employed. For example, Japanese Laid-Open Patent Application 61-258853 discloses a reversible thermo-sensitive recording material comprising a mixture of two or more kinds of polymers, which is capable of reversibly changing its state from a transparent state to a white opaque state, and vice versa, because of the differences in the compatible state of the polymers.

Japanese Laid-Open Patent Application 62-66990 discloses a reversible thermosensitive recording material comprising a liquid crystal polymer. In this reversible thermosensitive recording material, changes in the phase of the liquid crystal polymer are utilized for reversibly displaying images.

Furthermore, there are proposed several recording materials, each of which assumes a first color development state at a first predetermined temperature which is higher than room temperature, and further assumes a second color development state when the recording material is heated to a second predetermined temperature which is higher than the first temperature, and then cooled.

Of these recording materials, recording materials of the kind that assume different colors at the first and second temperatures are preferably employed in the present invention. For example, the following recording materials are preferably employed in the present invention: a recording material which can assume a transparent state at a first predetermined temperature and a milky white opaque state at a second predetermined temperature as disclosed in Japanese Laid-Open Patent Application 55-154198; recording materials which can produce a color at a second predetermined temperature and decolorize the produced color a first predetermined temperature as disclosed in Japanese Laid-Open Patent Applications 4-224996, 4-247985 and 4-267190; a recording material which can assume a milky white opaque state at a first predetermined temperature and a transparent state at a second predetermined temperature as disclosed in Japanese Laid-Open Patent Application 3-169590; and recording materials which can assume a black, red or blue color at a first predetermined temperature, and decolorize the produced color at a predetermined second temperature as disclosed in Japanese Laid-Open Patent Applications 2-188293 and 2-188294.

Of the above-mentioned reversible thermosensitive recording materials, the following representative type reversible thermosensitive recording materials are preferred for use in the present inventions:

(1) A recording material which can reversibly assume a transparent state and a milky while opaque state; and (2) A recording material which can cause a reversible color change by the chemical changes of a coloring material such as a dye contained therein.

As a representative example of the recording material (1), there is a recording material comprising a reversible thermosensitive recording layer, which comprises a matrix resin such as polyester, and an organic low-molecular-weight material such as a higher alcohol or a higher fatty acid, dispersed in the matrix resin. As a representative example of the recording material (2), there is a leuco-based thermosensitive recording material with improved reversibility.

The reversible thermosensitive recording material (1) capable of reversibly changing the transparency thereof comprises as the main components a matrix resin and an organic low-molecular-weight material dispersed in the matrix resin. This recording material (1) can assume a transparent state within a temperature region characteristic to the recording material.

The reversible thermosensitive recording material (1) utilizes its properties that the transparency can be changed reversibly from a transparent state to a milky white opaque state, and vice versa, depending on the temperature thereof. The differences between the transparent state and the milky white opaque state of the recording material (1) are considered to be caused as follows: In the transparent state, the matrix resin and the organic low-molecular-weight material dispersed therein are in close contact with each other without any gaps therebetween, and there are no vacant spaces within the organic low-molecular-weight material, either. Therefore, light which enters the reversible thermo-sensitive material from one side passes therethrough to the other side, without being scattered, thus the reversible thermosensitive recording material (1) appears transparent.

In contrast to this, when the thermosensitive recording material (1) is in the milky white opaque state, the organic low-molecular-weight material is composed of polycrystals consisting of numerous small crystals which include vacant spaces at the interfaces of the small crystals and also in the interfaces between the crystals of the low-molecular-weight material and the matrix resin, so that light which enters the reversible thermosensitive recording material (1) is refracted, reflected a number of times at such interfaces, and scattered within the reversible thermo-sensitive recording material (1). As a result, the thermosensitive recording material (1) appears to be in a milky white opaque state.

The transition of the state of a reversible thermosensitive recording layer of the recording material (1), depending on the temperature thereof, will now be more specifically explained by reference to FIG. 3.

Figure 3:
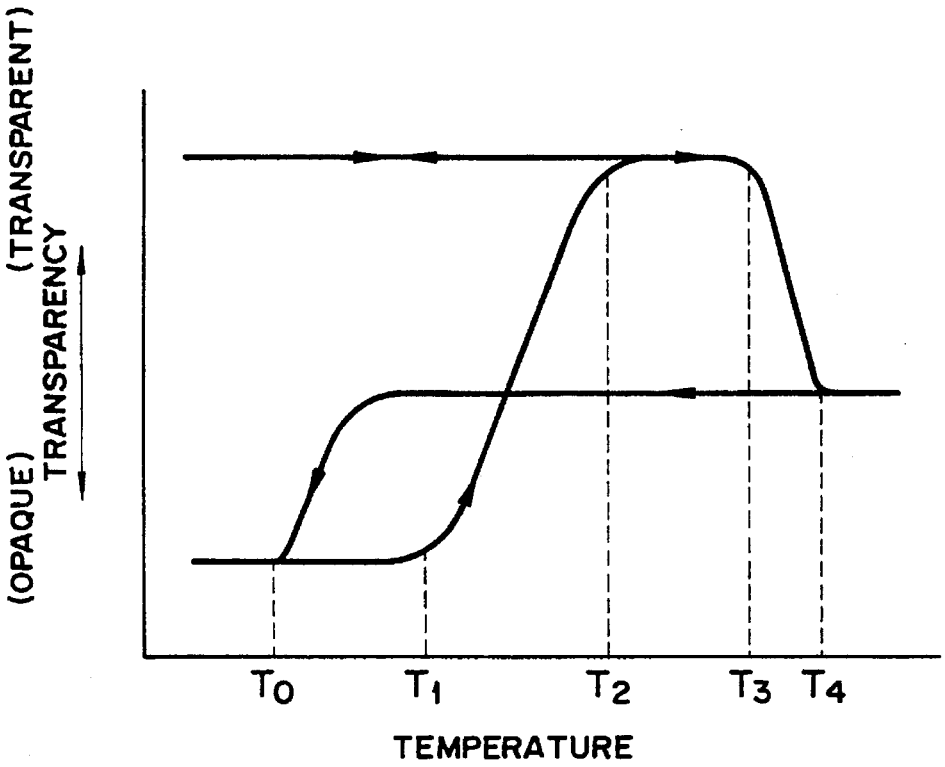
FIG. 3 is a diagram in explanation of the characteristics of a reversible thermosensitive recording layer of a reversible thermosensitive recording medium for use in the present invention.

In FIG. 3, it is supposed that the reversible thermosensitive recording layer comprising a matrix resin and an organic low-molecular-weight material dispersed in the matrix resin is initially in a milky white opaque state at room temperature $T_0$ or below. When the thermo-sensitive recording material is heated to temperature $T_1$ or above, the thermosensitive recording layer gradually becomes transparent, and reaches a maximum transparent state at temperature $T_2$ to $T_3$. Even if the recording material which is already in the maximum transparent state is cooled to room temperature $T_0$ or below, the maximum transparent state is maintained.

It is considered that this is because the matrix resin in the recording layer begins to be softened near temperature $T_1$, and as the softening of the matrix resin proceeds, the matrix resin shrinks, so that the vacant spaces between the resin and the particles of the organic lo-molecular-weight material or within the particles of the organic low-molecular-weight material are decreased. As a result, the transparency of the recording layer is gradually increased during the heating operation from $T_1$ to $T_3$. The organic low-molecular-weight material is in a semi-melted state at temperatures of $T_2$ to $T_3$, so that remaining vacant spaces in the recording layer are filled up with the melted organic low-molecular-weight material. Thus, the recording layer assumes the maximum transparent state. When the recording layer which is already in the maximum transparent state is cooled to room temperature $T_0$ or below, the organic low-molecular-weight material in the recording layer is cooled with seed crystals remaining therein, so that during the cooling operation to $T_0$ or below, the organic low-molecular-weight material crystallizes at a relatively high temperature. At this time, the matrix resin is still in the softened state, so that it serves to compensate for the volume changes of the particles of the organic low-molecular-weight material caused by the crystallization thereof. As a result, no vacant spaces are formed in the thermo-sensitive layer, thereby maintaining the transparent state.

When the recording layer in the maximum transparent state is further heated to temperature $T_4$ or more, it reaches a medium state which is between the maximum transparent state and the maximum milky white opaque state. When the recording material in the medium state at temperature $T_4$ or more is cooled to room temperature $T_0$ or below, the recording material returns to the original maximum opaque state, without passing through any transparent state. It is considered that this is because the organic low-molecular-weight material is completely melted when heated to temperature $T_4$ or above, and is then crystallized by supercooling at a temperature slightly higher than room temperature $T_0$. At this time, the matrix resin cannot compensate for the volume changes of the organic low-molecular-weight material caused by the crystallization, with the result that the vacant spaces are formed in the thermosensitive recording layer. As a result, the recording layer returns to the white opaque state.

The graph shown in FIG. 3, in explanation of the relationship between the transparency of the reversible thermosensitive recording material (1) and the temperature thereof, is Just one representative example of the recording material (1). The degree of transparency at each step varies depending on the kinds of components employed for the reversible thermosensitive recording material (1).

With the above-mentioned principle Of the reversible change in transparency being taken into consideration, a milky white opaque image can be obtained on a transparent background, or a transparent image can also be obtained on a milky white opaque background by selectively applying the thermal energy to the reversible thermo-sensitive recording material (1) in the present invention. Further, such image formation and erasure can be repeated over a long period of time.

When a colored sheet is placed behind the reversible thermosensitive recording layer of the recording material (1), colored images can be obtained on a white opaque background or a white opaque images can be obtained on a colored background.

In the case where the images formed in the reversible thermosensitive recording material (1) are projected on a screen using an over head projector (OHP), a milky white opaque portion in the recording material (1) appears dark and a transparent portion in the recording material (1) becomes a bright portion on the screen since the light passes therethrough. In addition, to use the images formed in the recording material (1) as reflected images, a light-reflection layer may be provided on the back side of the thermosensitive recording layer. When such a light-reflection layer is employed, the image contrast can be improved even though the thickness of the recording layer is decreased. The light-reflection layer can be prepared, for instance, by vacuum deposition of Al, Ni or Sn.

A reversible thermosensitive recording medium of the above-mentioned type can be prepared by coating a solution of the matrix resin and the organic low-molecular-weight material, or a dispersion prepared by dispersing finely-divided particles of the organic low-molecular-weight material in a solution of a matrix resin dissolved in a solvent in which at least one organic low-molecular-weight material is not dissolved, on a support such as a plastic film, glass plate or metallic plate, and then dried.

The solvent used for the formation of the thermo-sensitive recording layer or for the preparation of the reversible thermosensitive recording material (1) can be selected depending on the type of organic low-molecular-weight material and the kind of matrix resin to be employed. For example, tetrahydrofuran, methyl ethyl ketone, methyl isobutyl ketone, chloroform, carbon tetrachloride, ethanol, toluene and benzene can be employed. When not only the above-mentioned dispersion of the organic low-molecular-weight material, but also the solution of the matrix resin and the low-molecular-weight material is employed as the coating liquid, the organic low-molecular-weight material separates out in the form of finely-divided particles, which are dispersed in the obtained thermosensitive recording layer.

It is preferable to employ such matrix resins that can uniformly hold the particles of the organic low-molecular-weight material therein, and impart high transparency to the recording layer when the recording layer is in a maximum transparent state, and are mechanically stable and have excellent film-forming properties.

Specific examples of the matrix resin include polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer and vinyl chloride-acrylate copolymer; polyvinylidene chloride; vinylidene chloride copolymers such as vinylidene chloride-vinyl chloride copolymer and vinylidene chloride-acrylonitrile copolymer; polyester; polyamide; polyacrylate, polymethacrylate and acrylate-methacrylate copolymer; and silicone resin. These resins may be used alone or in combination.

The organic low-molecular-weight material for use in the reversible thermosensitive recording material (1) may appropriately be selected from the materials which are changeable from a polycrystalline state to a single crystalline state, and vice versa. It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids, and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials may be used alone or in combination.

It is preferable that the number of carbon atoms of the above-mentioned organic low-molecular-weight material be in the range of 10 to 60, more preferably in the range of 10 to 38, further preferably in the range of 10 to 30. The alcohol moieties in the esters may be saturated or unsaturated, and further may be substituted by a halogen. In any case, it is preferable that the organic low-molecular-weight material have at least one atom selected from the group consisting of oxygen, nitrogen, sulfur and a halogen in its molecule. More specifically, it is preferable that the organic low-molecular-weight materials comprise, for instance, —OH, —COOH, —CONH, —COOR (wherein R is $NH_4$ or an alkyl group having 1 to 20 carbon atoms), —NH, —$NH_2$, —S—, —S—S—, —O— or a halogen atom.

Specific examples of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid, and oleic acid; esters of higher fatty acids such as methyl stearate, tetradecyl stearate, octadecyl stearate, octadecyl laurate, tetradecyl palmitate and dodecyl behenate.

Of these, higher fatty acids having 16 or more carbon atoms, more preferably having 16 to 24 carbon atoms, such as palmitic acid, stearic acid, behenic acid and lignoceric acid are preferred in the present invention.

To increase the temperature region where the reversible thermosensitive recording material (1) is in the transparent state, the above-mentioned organic low-molecular-weight materials may appropriately be used in combination. Alternatively, the above-mentioned organic low-molecular-weight material may be used in combination with other materials having a different melting point, as disclosed in Japanese Laid-Open Patent Applications 63-39378 and 63-130380, and Japanese Patent Applications 63-14754 and 1-140109.

It is preferable that the ratio by weight of the amount of the organic low-molecular-weight material to the amount of the matrix resin be in the range of about (2:1) to (1:16), more preferably in the range of (1:2) to (1:8). When the organic low-molecular-weight material is contained in the matrix resin within the above range, the matrix resin can form a film in which the organic low-molecular-weight material is uniformly dispersed, and the obtained recording layer can readily reach the maximum white opaque state.

In the reversible thermosensitive recording layer of the recording material (1), additives such as a surface-active agent and a high-boiling point solvent may be contained to facilitate the formation of a transparent image.

Specific examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl aselate, dibutyl sebacate, di-2-ethylhexyl sebacate, diethylene glycol dibenzoate, triethylene glycol, di-2-ethylbutyrate, methyl acetylricinoleate, butyl acetylricinoleate, butylphthalyl butyl glycolate and tributyl acetylcitrate.

Specific examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil of higher fatty acid, and polypropylene glycol; acetylene glycol; sodium, calcium, barium and magnesium salts of higher alkyl bensenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; copolymer of long-chain alkyl methacrylate and amine-containing monomer; styrene-maleic anhydride copolymer; and olefin-maleic anhydride copolymer.

The previously mentioned reversible thermosensitive recording material (2) which is used for the image recording portions in the recording medium will now be explained in detail.

The recording material (2) comprises a reversible thermosensitive coloring composition comprising an electron donor type coloring compound and an electron acceptor type compound and utilizes a coloring reaction between these two compounds.

More specifically, when a mixture of the electron donor coloring compound and the electron acceptor compound is fused under application of heat thereto, an amorphous colored material is formed, whereby a color development state is formed. The temperature at which the color development state is formed is herein-after referred to as a color development temperature.

Furthermore, when the amorphous colored material thus obtained is heated to a temperature lower than the color development temperature, the colored material is decolorized with the crystallization of the electron acceptor compound. Thus, a decolorization state is formed.

The thermosensitive coloring composition is instantaneously colored by the application of heat thereto to produce a color development state. This color development state can be maintained stable at room temperature. The color produced in the thermosensitive coloring composition in the color development state is instantly decolorized when the coloring composition is heated to a temperature lower than the color development temperature, and the thus obtained decolorization state can be stably maintained at room temperature.

The process of the color development and decolorization, namely, the process of image formation and erasure, which can be attained by use of the reversible thermo-sensitive recording material (2) comprising the above-mentioned thermosensitive coloring composition, will now be explained with reference to the graph shown in FIG. 4.

Figure 4:
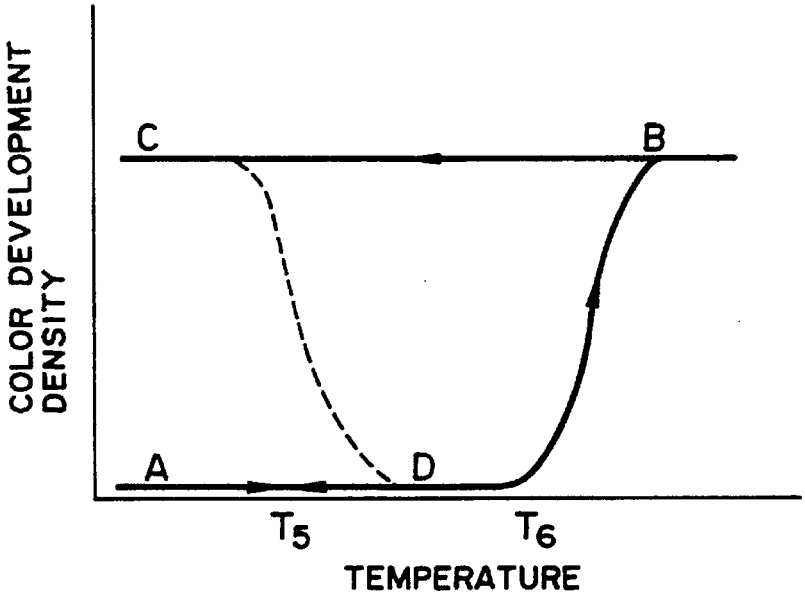
FIG. 4 is a diagram in explanation of the characteristics of a reversible thermosensitive recording layer of another reversible thermosensitive recording medium for use in the present invention.

In FIG. 4, the color development density of the recording material (2) is plotted as ordinate and the temperature thereof as abscissa. The solid line indicates the image formation process by the application of heat to the reversible thermosensitive recording material (2), and the broken line indicates the image erasure process by the application of heat thereto. Density A indicates the initial density of the recording material (2) in a complete decolorization state; density B, the density in a complete color development state obtained by heating the coloring composition to temperature of $T_6$ or more; density C, the density in a complete color development state at temperature $T_{=}$or less; and density D, the density in a complete decolorization state obtained when the coloring composition in the color development state at $T_5$ or less is heated at a temperature in a range from $T_5$ to $T_6$.

The coloring composition is initially in a decolorization state with the density A at temperature $T_5$ or less. When the coloring composition is heated to temperature $T_6$ or more, for example, by use of a thermal head, the coloring composition induces color development with the density B, whereby recording images are formed. The thus obtained density B of the coloring composition does not decrease even if the coloring composition is cooled to $T_5$ or less as indicated by the solid line, and the density of the obtained image can be maintained as the density C. Thus, the memory of the recorded is not lost.

To erase images formed in the recording material (2), the coloring composition in the recording material (2) which is in the color development state at $T_5$ or less may be again heated to a temperature in a range of $T_5$ to $T_6$, which is lower than the color development temperature, as indicated by the broken line. Thus, the image density is decreased from C to D, thereby allowing the coloring composition to assume a colorless decolorization state. Once the coloring composition assumes this colorless decolorization state, the density of the coloring composition is maintained at the density A even if the temperature of the coloring composition is returned to $T_5$ or less. In other words, the image formation operation proceeds along the path indicated by the solid line A-B-C, and the recorded images are held in the recording material (2) et the step C. The image erasing operation proceeds along the path indicated by the broken line C-D-A, and the decolorization state of the recording material (2) can be maintained at the step A. Such image formation and erasure are reversible, and can be repeated a number of times.

As previously mentioned, the reversible thermo-sensitive coloring composition for use in the recording material (2) comprises as indispensable components the electron donor coloring compound serving as a coloring agent and the electron acceptor compound serving as a color developer. When a mixture of the coloring agent and the color developer is fused by the application of heat thereto, it assumes a color development state; while when the mixture in the color development state is again heated to a temperature lower than the color development temperature, the color produced in the mixture of the coloring agent and the color developer is lost. Both the color development state and the decolorization state can be maintained in a stable condition at room temperature. The color development mechanism of the coloring composition is such that when the coloring composition is heated to the color development temperature, the coloring composition is made amorphous, whereby a color development state is produced as mentioned previously. On the other hand, when the coloring composition in the color development state is again heated to a temperature lower than the color development temperature, the color developer in the coloring composition is crystallized, whereby a decolorized state is produced.

Even in this case, when the coloring composition is heated to a temperature higher than $T_6$, and recorded images are decolorized, the particles of the coloring agent and the color developer can be returned to the respective initial states, so that a new colored state can be advantageously produced.

A coloring composition comprising a conventional coloring agent and a conventional color developer, for example, a leuco compound having a lactone ring, which is a dye precursor, and a phenolic compound serving as a color developer, which are widely used in the conventional thermosensitive recording sheets, is caused to assume a color development state due the opening of the lactone ring of the leuco compound when the mixture of the leuco compound and the phenolic compound is fused under application of heat thereto. In such a color development state, the coloring composition assumes an amorphous state in which both the leuco compound and the phenolic compound are mutually dissolved. The amorphous state of the coloring composition can be maintained in a stable condition at room temperature. However, even if the coloring composition in the amorphous state is again heated, the phenolic compound is not crystallized, separated out of the leuco compound, so that the lactone ring of the leuco compound is not closed. The result is that the coloring composition is not decolorized.

In contrast to the above, when the reversible thermosensitive coloring composition for use in the present invention, comprising a coloring agent and a color developer, is heated to so as to fuse and mix the coloring agent and the color developer, the coloring composition assumes an amorphous state in a color development state in the same manner as in the case of the conventional coloring compositions, and this state is stable at room temperature.

However, in the case of the reversible thermo-sensitive coloring composition for use in the present invention, when the coloring composition in the amorphous state is heated to a temperature lower than the color development temperature, that is, to a temperature at which no fused state is obtained, the color developer is crystallized, so that the mutually dissolved state of the color developer and the coloring agent cannot be maintained. As a result, the color developer is separated from the coloring agent. When the color developer is separated from the coloring agent because of the crystallization of the color developer, the color developer cannot accept electrons from the coloring agent, so that the coloring agent is decolorized.

Such a peculiar behavior of color development and decolorization of the reversible thermosensitive coloring composition is affected by the mutual solubility of the coloring agent and the color developer when they are fused under application of heat thereto, the intensity of the actions of the coloring agent and the color developer in the color development state, the solubility of the color developer in the coloring agent, and the crystallizability of the color developer. In principle, there can be employed any coloring composition comprising a coloring agent and a color developer, which is caused to assume an amorphous state when fused under application of heat thereto, and which is crystallized when heated to a temperature lower than the color development temperature, for the recording material for use in the present invention. Such a coloring composition exhibits endothermic changes in the course of the fusion, and exothermic changes in the course of the crystallization according to the thermal analysis. Therefore, it is easy to find the coloring composition suitable for the recording material for use in the present invention by the thermal analysis. In addition, the reversible thermosensitive coloring composition for the recording material for use in the present invention may comprise a third material, for example, a polymeric material. It has been confirmed that the coloring composition further comprising the polymeric material can show the same behavior of color development and decolorization as previously stated.

The decolorization of the reversible thermosensitive coloring composition results from the crystallization of the color developer out of the coloring agent. With this fact taken into consideration, the selection of the color developer is significant for obtaining the recording material (2) which can show excellent decolorization performance.

Preferable examples of the color developer for use in the recording material for use in the present invention are shown below, which can easily be found by the thermal analysis, so that they are not limited to the following compounds.

(1) Organic phosphoric acid compounds represented by formula (1):

$$R^1—PO(OH)_2 \quad (1)$$

wherein $R^1$ represents a straight-chain or branched alkyl group or alkenyl group having 8 to 30 carbon atoms.

Specific examples of the aforementioned organic phosphoric acid compound are octyl phosphonic acid, nonyl phosphonic acid, decyl phosphonic acid, dodecyl phosphonic acid, tetradecyl phosphonic acid, hexadecyl phosphonic acid, octadecyl phosphonic acid, eicosyl phosphonic acid, docosyl phosphonic acid and tetracosyl phosphonic acid.

(2) Organic acids having a hydroxyl group at the α-position, represented by formula (2):

$$R^2—CH(OH)COOH \quad (2)$$

wherein $R^2$ represents a straight-chain or branched alkyl group or alkenyl group having 6 to 28 carbon atoms.

Specific examples of the aforementioned organic acid having a hydroxyl group at the α-position include α-hydroxyoctanoic acid, α-hydroxydodecanoic acid, α-hydroxyteraecanoic acid, α-hydroxyhexadecanoic acid, α-hydroxyocydecanoic acid, α-hydroxypentedecenoic acid, α-hydroxypentadecanic acid, and α-hydroxyeicosanoic acid, and α-hydroxydocosanic acid.

The coloring agent for use in the recording material (2) is an electron donor compound, such as a colorless or light-colored dye precursor. For example, conventionally known leuco compounds such as triphenylmethane phthalide compounds, fluoran compounds, phenothiazine compounds, leuco auramine compounds, rhodamine lactam compounds, spiropyran compounds and indolinophthalide compounds can be employed.

The previously mentioned color developers can be used alone or in combination. The coloring agents can also be used alone or in combination.

By forming a thermosensitive recording layer comprising the reversible thermosensitive coloring composition on a support, the reversible thermosensitive recording material (2) for use in the present invention can be prepared. In this case, the coloring agent, the color developer and a binder agent are uniformly dispersed or dissolved in water or an appropriate organic solvent by a conventional method to prepare a coating liquid for the thermosensitive recording layer. Thereafter, the coating liquid for the recording layer thus prepared is coated on the support.

Examples of the binder agent for use in the coating liquid for the thermosensitive recording layer are various kinds of conventional binder agents, such as polyvinyl alcohol, hydroxyethyl cellulose, hydroxypropyl cellulose, methoxy cellulose, carboxymethyl cellulose, methyl cellulose, cellulose acetate, gelatin, casein, starch, sodium polyacrylate, polyvinyl pyrrolidone, polyacrylamide, maleic acid copolymer, acrylic acid copolymer, polystyrene, polyvinyl chloride, polyvinyl acetate, polyecrylate, polymethacrylate, vinyl chloride-vinyl acetate copolymer, styrene copolymer, polyester, and polyurethane.

When necessary, a variety of auxiliary additive components which are used in the conventional thermosensitive recording materials, such as a dispersant, a surface active agent, a filler, a colored image stabilizing agent, an antioxidant, a light stabilizer and a lubricant can be employed with the above-mentioned leuco dye and the color developer for the improvements in coating properties of the coating liquid and the recording characteristics of the obtained recording material (2).

The resins for the reversible thermosensitive recording layer 1*b* may be cross-linked, when necessary, with the addition of functional groups thereto, in the presence of a cross-linking agent or a photopolymerization initiator, by the application of heat, ultraviolet rays, or electron rays thereto in the same manner as for the resins for the light-to-heat conversion layer 26*b*.

The above cross-linking agent or photopolymerization initiator may be the same as for the cross linking of the resins for the light-to-heat conversion layer 2*b*.

Other features of this invention will become apparent in the course of the following description of exemplary embodiments, which are give for illustration of the invention and are not intended to be limiting thereof.

Reference Example 1-1

[Preparation of Light-to-Heat Conversion Sheet (A)]

A coating liquid with the following formulation was coated on a transparent polyester film (Trademark "Lumirror T-60" made by Toray Industries, Inc.) with a thickness of about 100 μm by a wire bar:

| | Parts by Weight |
|---|---|
| Carbon black | 20 |
| Polyester (Tradamark: "Vylon 200", made by Toyobo Co., Ltd.) | 20 |
| Methyl ethyl ketone | 80 |
| Toluene | 80 |

The coated liquid was dried with the application of heat thereto, whereby a light-to-heat conversion layer with a thickness of about 1.0 μm was formed on the transparent polyester film. Thus a light-to-heat conversion sheet (A) was prepared.

Reference Example 1-2

[Preparation of Light-to-heat Conversion Sheet (B)]

A coating liquid with the following formulation was coated on a transparent polyester film (Trademark "Lumirror T-60" made by Toray Industries, Inc.) with a thickness of about 100 μm by a wire bar:

| | Parts by Weight |
|---|---|
| Carbon black | 20 |
| Vinyl chloride - vinyl acetate - vinyl alcohol copolymer (Tradmark: "VAGH", made by Union Carbide Japan K.K.) | 20 |
| Isocyanate (Trademark: "Coronate L", made by Nippon Polyurethane Industry Co., Ltd.) | 2 |
| Triethylone diamine (made by Tokyo Kasei Kogyo Co., Ltd.) | 0.2 |
| Methyl ethyl ketone | 80 |
| Toluene | 80 |

The coated liquid was dried with the application of heat thereto, whereby a light-to-heat conversion layer with a thickness of about 1.0 μm was formed on the transparent polyester film.

The light-to-heat conversion layer formed on the transparent polyester film was allowed to stand at 50° C. for 24 hours, whereby the light-to-heat conversion layer was cured. Thus a light-to-heat conversion sheet (B) was prepared.

Reference Example 1-3

[Preparation of Light-to-Heat Conversion Sheet (C)]

A coating liquid with the following formulation was coated on the light-to-heat conversion layer of the above prepared light-to-heat conversion sheet (A) by a wire bar:

| | Parts by Weight |
|---|---|
| 75% butyl acetate solution of urethane acrylate-based ultraviolet-curing resin (Trademark: "Unidic C7-157", made by Dainippon Ink & Chemicals, Incorporated.) | 10 |
| Isopropyl alcohol | 10 |

The coating liquid coated on the light-to-heat conversion layer of the light-to-heat conversion sheet (A) was dried with the application of heat thereto, and was then cured by the application of ultraviolet rays thereto by use of an 80 W/cm ultraviolet lamp, whereby a heat resistant layer with a thickness of about 1.5 μm was formed on the light-to-heat conversion layer of the light-to-heat conversion sheet (A). Thus, a light-to-heat conversion sheet (C) was prepared.

Reference Example 2-1

[Preparation of Reversible Thermosensitive Recording Medium No. 1]

A coating liquid with the following formulation was coated on a transparent polyester film (Trademark "Lumirror T-60" made by Toray Industries, Inc.) with a thickness of 125 μm by a wire bar:

| | Parts by Weight |
|---|---|
| Behenic acid (Trademarks "NAA-22S", made by Nippon Oils and Fats Co.; Ltd.) | 5 |
| Eicosanedioic acid (Trademark: "SL-20-99", made by Okamura Oil Mill Ltd.) | 5 |
| Vinyl chloride-vinyl acetate copolymer (Trademark: "Kaneka M2018", made by Kanegafuchi | 40 |

-continued

| | Parts by Weight |
|---|---|
| Chemical Industry Co., Ltd.) | |
| Tetrahydrofuran | 200 |
| Toluene | 20 |

The coating liquid coated on the transparent polyester film was dried at 130°C. for 3 minutes, whereby a reversible thermosensitive recording layer with a thickness of about 10 μm was formed on the transparent polyester film. The reversible thermosensitive recording layer was then heated to 90° C. for 1 minute, whereby the reversible thermosensitive recording layer was made transparent. Thus, a reversible thermosensitive recording medium No. 1 was prepared.

Reference Example 2-2

[Preparation of Reversible Thermosensitive Recording Medium No. 2]

A coating liquid with the following formulation was coated on a transparent polyester film (Trademark "Lumirror T-60" made by Toray Industries, Inc.) with a thickness of 125 μm by a wire bar:

| | Parts by Weight |
|---|---|
| Behenic acid (Trademark: "NAA-22S", made by Nippon Oils and Fats Co., Ltd.) | 5 |
| Eicosanedioic acid (Trademark: "SL-20-99", made by Okamura Oil Mill Ltd.) | 5 |
| Vinyl chloride-vinyl acetate copolymer (Trademark: "Kaneka M2018", made by Kanegafuchi Chemical Industry Co., Ltd.) | 40 |
| ε-caprolactone adduct of dipentaerythritol hexaacrylate (Trademark "DPCA-30" made by Nippon Kayaku Co., Ltd.) | 6 |
| Tetrahydrofuran | 200 |
| Toluene | 20 |

The coating liquid coated on the transparent polyester film was dried at 130° C. for 3 minutes, whereby a reversible thermosensitive recording layer with a thickness of about 10 μm was formed on the transparent polyester film.

The reversible thermosensitive recording layer was then irradiated with electron rays with an irradiation dose of 20 Mrad by use of an electron ray irradiation apparatus (Trademark "EBC-200-$AA_2$" made by Nisshin High Voltage Co., Ltd.), whereby the reversible thermo-sensitive recording layer was cross-linked.

The reversible thermosensitive recording layer was then heated to 90° C. for 1 minute, whereby the reversible thermosensitive recording layer was made transparent. Thus, a reversible thermosensitive recording medium No. 2 was prepared.

Reference Example 2-3

[Preparation of Reversible Thermosensitive Recording Medium No. 3]

A coating liquid with the following formulation was coated on the reversible thermosensitive recording layer of the reversible thermosensitive recording medium No. 1 prepared in Reference Example 2-1 by a wire bar:

| | Parts by Weight |
|---|---|
| 75% butyl acetate solution of urethane acrylate-based ultraviolet-curing regin (Trademark: "Unidic C7-157", made by Dainippon Ink & Chemicals, Incorporated.) | 10 |
| Isopropyl alcohol | 10 |

The above coating liquid coated on the reversible thermosensitive lye recording layer was dried with the application of heat thereto, and was then cured by the application of ultraviolet rays thereto by use of an 80 W/cm ultraviolet lamp, whereby a protective layer with a thickness of about 3 μm was formed on the thermosensitive recording layer of the reversible thermosensitive recording medium No. 1.

The above reversible thermosensitive recording medium was then heated to 90° C. for 1 minute, whereby the reversible thermosensitive recording layer was made transparent. Thus, a reversible thermosensitive recording medium No. 3 was prepared.

EXAMPLES 1 to 9

Each of the thus prepared light-to-heat conversion sheets (A), (B) and (C) prepared in Reference Examples 1-1 to 1-3 was superimposed on the reversible thermosensitive recording media No. 1 to No. 3 prepared in Reference Examples 2-1 to 2-3 in the combinations as shown in TABLE 1 in such a manner that the light-to-heat conversion layer of each light-to-heat conversion sheet was directed to the side of the reversible thermo-sensitive recording layer of each reversible thermo-sensitive recording medium, and heat was applied to the respective combinations of the light-to-heat conversion sheets (A), (B) and (C) and the reversible thermosensitive recording media No. 1 to No. 3 to 80° C., 100° C. and 150° C., with the application of a pressure of 1 g/$cm^2$ for 60 seconds by use of a commercially available heat gradient tester (Trademark "Type HG-100" made by Toyo Seiki Seisaku-sho, Ltd.) for image formation, for the observation of the occurrence of the peeling of the light-to-heat conversion layer or the reversible thermosensitive recording layer away from the respective supports, and also for the observation of mutual transfer of the light-to-heat conversion layer and the reversible thermosensitive recording layer between the two layers.

The results are shown in TABLE 1.

Each of the light-to-heat conversion sheets (A), (B) and (C) was superimposed on the reversible thermo-sensitive recording media No. 1 to No. 3 in the same manner as mentioned above in the combinations thereof as shown in TABLE 1, and image formation was conducted by use of the laser recording apparatus as shown in FIG. 2.

As shown in FIG. 2, this recording apparatus comprises a laser diode 34 serving as a light source, an optical head portion provided with a laser irradiation optical system, a recording portion for performing a main scanning by the rotation of a drum 31, and a subscanning portion for moving an optical head 32 for recording by a moving microstage 33. In this recording apparatus, the operation of the laser diode 34 based on image recording signals, the rotation of the drum 31, and the movement of the microstage 33 are controlled by a microcomputer.

As the above-mentioned light source, a simple basic mode semiconductor laser diode with a maximum continuous oscillation output of 100 mW (Trademark "SDL7032" with an oscillation wavelength of 830 nm, made by Sanyo Electric Co., Ltd.) was employed. The diameter of a light spot obtained by this recording apparatus was bout 3 μm.

By use of this recording apparatus, image formation was conducted under the conditions that the scanning speed of a laser beam was set at 20.7 mm/sec, and the laser output was set at 12 mW and also at 20 mW.

After the image formation, the light-to-heat conversion sheet was removed from each of the reversible thermosensitive recording media.

The results of these image formations are shown in TABLE 1. On the reversible thermosensitive recording media which was free from the previously mentioned peeling and transfer, clear milky white images were formed.

TABLE 1

| | Light-to-heat Conversion Sheet | Reversible thermosensitive Recording medium | Recording by Heat Application by Heat Gradient Tester 80° C. | 100° C. | 150° C. | Recording by Laser Beam Application 12 mw | 20 mw |
|---|---|---|---|---|---|---|---|
| Ex. 1 | A | No. 1 | Δ | X | X | Δ | X |
| Ex. 2 | A | No. 2 | o | o | Δ | o | Δ |
| Ex. 3 | A | No. 3 | o | o | Δ | o | Δ |
| Ex. 4 | B | No. 1 | o | o | Δ | o | Δ |
| Ex. 5 | B | No. 2 | o | o | o | o | o |
| Ex. 6 | B | No. 3 | o | o | o | o | o |
| Ex. 7 | C | No. 1 | o | o | Δ | o | Δ |
| Ex. 8 | C | No. 2 | o | o | o | o | o |
| Ex. 9 | C | No. 3 | o | o | o | o | o |

o: Neither peeled nor transferred.
Δ: Partly peeled and transferred.
X: Entirely peeled and transferred.

EXAMPLE 10

The light-to-heat conversion sheet (A) prepared in Reference Example 1-1 was superimposed on the reversible thermosensitive recording medium No. 1 prepared in Reference Example 2-1 in such a manner that the light-to-heat conversion layer of the light-to-heat conversion sheet (A) was directed to the reversible thermosensitive recording layer of the reversible thermosensitive recording medium No. 1, with spacer particles with a particle size of about 6 μm (Trademark "Micropearl", made by Sekisui Fine Chemical Co., Ltd.), and heat was applied thereto in the same manner as in Example 1 to 80° C., 100° C. and 150° C., with the application of a pressure of 1 g/cm$^2$ for 60 seconds by use of a commercially available heat gradient tester (Trademark "Type HG-100" made by Toyo Seiki Seisaku-sho, Ltd.) for image formation, for the observation of the occurrence of the peeling of the light-to-heat conversion layer or the reversible thermosensitive recording layer away from the respective supports and also for the observation of mutual transfer of the light-to-heat conversion layer and the reversible thermosensitive recording layer between the two layers.

The result was that clear images free from the previously mentioned peeling and transfer were obtained.

By use of the above combination of the light-to-heat conversion sheet (A) and the reversible thermosensitive recording medium No. 1 with the same spacer particles as mentioned above being interposed therebetween, image formation was conducted by use of the same laser recording apparatus as employed in Example 1.

As a result clear images free from the peeling and transfer were obtained.

EXAMPLE 11

The light-to-heat conversion sheet (A) prepared in Reference Example 1-1 was superimposed on the reversible thermosensitive recording medium No. 1 prepared in Reference Example 2-1 in such a manner that the light-to-heat conversion layer of the light-to-heat conversion sheet (A) was directed to the reversible thermosensitive recording layer of the reversible thermosensitive recording medium No. 1, with a commercially available silicone oil (Trademark: "KF54", made by Shin-Etsu Chemical Co., Ltd.) being interposed therebetween, and image formation was conducted by use of the same laser recording apparatus as employed in Example 1 under the conditions that the laser output was 12 mW and the scanning speed of the laser beam was set at 20.7 mm/sec.

The result was that clear images free from the previously mentioned peeling and transfer were obtained, with a more uniform line width than that of the corresponding images obtained under the same conditions as mentioned above in Example 1.

EXAMPLE 12

The light-to-heat conversion sheet (C) prepared in Reference Example 1-3 was superimposed on the reversible thermosensitive recording medium No. 3 prepared in Reference Example 2-3 in such a manner that the light-to-heat conversion layer of the light-to-heat conversion sheet (C) was directed to the reversible thermosensitive recording layer of the reversible thermosensitive recording medium No. 3 in the same manner as in Example 9, and image formation was conducted by use of the same laser recording apparatus as employed in Example 1 under the conditions that the drum 31 was heated to 45° C., the laser output was set at 8 mW and the scanning speed of the laser beam was set at 20.7 mm/sec.

The result was that most clear images free from the previously mentioned peeling and transfer were obtained, with a line width of about 16 μm, even under the above-mentioned conditions.

The minimum crystallization temperature of the organic low-molecular-weight material employed in the reversible thermosensitive recording layer of the reversible thermosensitive recording medium No. 3 was about 42° C. when measured by use of a differential scanning calorimeter (DSC) (Trademark "DSC 3100" made by MacScience Co., Ltd.) with the temperature increasing and decreasing rate thereof being set at 2° C./min.

EXAMPLE 13

The same image formation procedure as in Example 12 was repeated except that the temperature of the drum 31 was raised to 90° C.

The result was that clear images free from the previously mentioned peeling and transfer, with a line width of about 15 μm, were obtained even under the conditions that the laser output for the laser recording apparatus was set at 4 mW.

Image formation was conducted in a portion of this recording medium which was different from the previously used portion thereof within the same recording apparatus under the same conditions as mentioned above. The result was that the previously formed images were made transparent and erased, and milky white images were formed in the different portion.

EXAMPLE 14

The light-to-heat conversion sheet (C) prepared in Reference Example 1-3 was superimposed on the reversible thermosensitive recording medium No. 3 prepared in Reference Example 2-3 in such a manner that the light-to-heat conversion layer of the light-to-heat conversion sheet (A) was directed to the reversible thermosensitive recording layer of the reversible thermosensitive recording medium No. 3, and image formation was conducted by use of the same laser recording apparatus as employed in Example 1 under the conditions that the laser output was 12 mW and the scanning speed of the laser beam was set at 20.7 nm/sec.

As a result, clear milky white opaque images, with a line width of about 15 μm, were obtained.

The thus formed milky white opaque images were irradiated with a laser beam with a laser output of 12 mW at a scanning speed of 15.8 m/sec. The result was that the milky white images were made transparent and erased.

Comparative Example

The same reversible thermosensitive recording layer as that of the reversible thermosensitive recording medium No. 1 prepared in Reference Example 2-1 was formed on the light-to-heat conversion sheet (A) prepared in Reference Example 1-1 in the same manner as in Reference Example 2-1, whereby a comparative reversible thermo-sensitive recording medium was prepared.

Image formation was conducted in the thus obtained comparative reversible thermosensitive recording medium by use of the same laser recording apparatus as employed in Example 1 under the conditions that the laser output was set at 8 mW and the scanning speed of the laser beam was set at 24 mm/sec.

As a result, milky white opaque images, with a line width of about 12 μm, were formed with high recording sensitivity. However, the milky white portions of the thus obtained images were grayish and the contrast thereof was so low that the images were barely recognized by visual inspection.

Japanese Patent Application No. 5-312557 filed on Nov. 18, 1993 is hereby incorporated by reference.

What is claimed is:

1. An image recording and erasing method for recording images and erasing the same repeatedly by use of a reversible thermosensitive recording medium which is capable of reversibly changing the transparency and color tone thereof depending upon the temperature thereof, comprising the steps:

disposing a light-to-heat conversion sheet over said reversible thermosensitive recording medium;

applying a laser beam to said light-to-heat conversion sheet to heat said reversible thermosensitive recording medium by the heat generated by said light-to-heat conversion sheet upon the application of said laser beam thereto, thereby forming images on said reversible thermosensitive recording medium and/or erasing images therefrom; and removing said light-to-heat conversion sheet away from said reversible thermosensitive recording medium.

2. The image recording and erasing method as claimed in claim 1, wherein at least part of said light-to-heat conversion sheet is in contact with at least part of said reversible thermosensitive recording medium, and the adhesion initiation temperature at which the adhesion between said light-to-heat conversion sheet and said reversible thermosensitive recording medium is initiated is above 90° C.

3. The image recording and erasing method as claimed in claim 2, wherein said adhesion initiation temperature is above 150° C.

4. The image recording and erasing method as claimed in claim 2, wherein a heat resistant layer is further provided on a top surface portion of said light-to-heat conversion sheet which is directed to said reversible thermosensitive recording medium.

5. The image recording and erasing method as claimed in claim 2, wherein said light-to-heat conversion sheet comprises a support and a light-to-heat conversion layer formed thereon, which comprises a cross-linked resin.

6. The image recording and erasing method as claimed in claim 3, wherein a heat resistant and layer is further her provided on a top surface portion of said light-to-heat conversion sheet which is directed to said reversible thermosensitive recording medium.

7. The image recording and erasing method as claimed in claim 3, wherein said light-to-heat conversion sheet comprises a support and a light-to-heat conversion layer formed thereon, which comprises a cross-linked resin.

8. The image recording and erasing method as claimed in claim 1, wherein said light-to-heat conversion sheet and said thermosensitive recording medium are overlaid with a non-contact space of 0.1 μm to 20 μm therebetween.

9. The image recording and erasing method as claimed in claim 8, wherein said non-contact space contains spacer particles.

10. The image recording and erasing method as claimed in claim 8, wherein said non-contact space contains a liquid.

11. The image recording and erasing method as claimed in claim 1, further comprising the step of heating said reversible thermosensitive recording medium by heat application means after or before disposing said light-to-heat conversion sheet over said reversible thermosensitive recording medium.

12. The image recording and erasing method as claimed in claim 11, wherein said reversible thermo-sensitive recording medium comprises a matrix resin and an organic low-molecular-weight material having a minimum crystallization temperature, which is dispersed in the form of particles in said matrix resin, and is capable of reversibly changing the transparency thereof from a transparent state to a milky white opaque state and vice versa by the application of heat thereto, and when applying a laser beam to said light-to-heat conversion sheet to heat said reversible thermosensitive recording medium for forming images on said reversible thermo-sensitive recording medium and/or erasing images therefrom, said reversible thermosensitive recording medium is heated to a temperature higher than said minimum crystallization temperature of said organic low-molecular-weight material.

13. The image recording and erasing method as claimed in claim 1, wherein said images are formed by heating said reversible thermosensitive recording medium by applying said laser beam thereto through said light-to-heat conversion sheet, and images are erased by heating said reversible thermosensitive recording medium by heat application means.

14. The image recording and erasing method as claimed in claim 1, wherein both the formation of said images on said reversible thermosensitive recording medium and the erasure of images therefrom are carried out by the application of laser beams to said light-to-heat conversion sheet, with at least one factor selected from the group consisting of the irradiation time, light quantity, focusing and intensity distribution of said laser beams being controlled.

15. The image recording and erasing method as claimed in claim 11, wherein said heat application means is a hot stamp.

16. The recording and erasing method as claimed in claim 11, wherein said heat application means is a heat roller.

17. The recording and erasing method as claimed in claim 11, wherein said heat application means is an oven.

18. The recording and erasing method as claimed in claim 11, wherein said heat application means is a thermal head.

19. The image recording and erasing method as claimed in claim 13, wherein said heat application means is a hot stamp.

20. The recording and erasing method as claimed in claim 13, wherein said heat application means is a heat roller.

21. The recording and erasing method as claimed in claim 13, wherein said heat application means is an oven.

22. The recording and erasing method as claimed in claim 13, wherein said heat application means is a thermal head.

* * * * *

UNITED STATES PATENT AND TRADEMARK OFFICE

CERTIFICATE OF CORRECTION

PATENT NO. : 5,619,243

DATED : APRIL 08, 1997

INVENTOR(S) : YOSHIHIKO HOTTA, ET AL.

It is certified that error appears in the above-identified patent and that said Letters Patent is hereby corrected as shown below:

IN THE SPECIFICATION

Column 1, line 32, change "fractioned" to --frictioned--;

line 36, change "head" to --heat--;

line 62, change "carbon-back" to --carbon-black--.

Column 4, line 4, change "...layer 2b may made of..." to --layer 2b may be made of--;

line 65, delete the word "that".

Column 5, line 1, delete the word "of";

line 32, change "light-of-heat" to --light-to-heat--.

Column 6, line 20, change "end" to --and--.

Column 9, line 18, after "also" insert --be--;

line 59, change "DeC" TO --DSC--.

Column 11, line 20, change "while" to --white--.

Column 12, line 18, change "lo" to --low--;

line 61, change "Just" to --just--;

line 65, change "Of" to --of--.

Column 13, line 10, change "images" to --image--.

Column 16, line 15, change "$T_{=}$" to --$T_5$;

UNITED STATES PATENT AND TRADEMARK OFFICE

CERTIFICATE OF CORRECTION

PATENT NO. : 5,619,243

DATED : APRIL 08, 1997

INVENTOR(S) : YOSHIHIKO HOTTA, ET AL.

It is certified that error appears in the above-indentified patent and that said Letters Patent is hereby corrected as shown below:

Column 16, line 45, change "et" to --at--.

Column 17, line 18, after "due" insert --to--.

Column 18, lines 44-45, change "α-hydroxyteraecanoic" to --α-hydroxytetradecanoic--;

lines 45-46, change "α-hydroxyocydecanoic" to --α-hydroxyoctadecanoic--;

line 46, change "α-hydroxypentedecenoic" to --α-hydroxypentadecanoic--;

Column 18, change "α-hydroxydocanic" to α-hydroxydodecanoic--.

Column 19, line 30, change " "26b" to --2b--;

line 36, change "give" to --given--.

UNITED STATES PATENT AND TRADEMARK OFFICE

CERTIFICATE OF CORRECTION

PATENT NO. : 5,619,243

DATED : APRIL 08, 1997

INVENTOR(S) : YOSHIHIKO HOTTA, ET AL.

It is certified that error appears in the above-indentified patent and that said Letters Patent is hereby corrected as shown below:

Column 22, line 6, change "ultraviolet-curing regin" to --ultraviolet-curing resin--;

line 12, delete "lye"

Column 23, line 3, change "bout" to --about--.

Column 26, line 4, delete "is" (second occurrence);

line 18, delete "and";

line 18, delete "her".

Signed and Sealed this

Seventh Day of April, 1998

Bruce Lehman

*Attest:*

BRUCE LEHMAN

*Attesting Officer*

*Commissioner of Patents and Trademarks*